US010426689B2

(12) United States Patent
Weber et al.

(10) Patent No.: US 10,426,689 B2
(45) Date of Patent: Oct. 1, 2019

(54) BIOMECHANICAL AND ERGONOMICAL ADJUSTABLE CRUTCH

(71) Applicant: Mobi Acquisition Company, LLC, Minneapolis, MN (US)

(72) Inventors: Jeffrey A. Weber, Golden Valley, MN (US); Matthew Steinrueck, Minneapolis, MN (US)

(73) Assignee: Mobi Acquisition Company, LLC, Minneapolis, MN (US)

( * ) Notice: Subject to any disclaimer, the term of this patent is extended or adjusted under 35 U.S.C. 154(b) by 123 days.

(21) Appl. No.: 15/658,099

(22) Filed: Jul. 24, 2017

(65) Prior Publication Data

US 2018/0021202 A1 Jan. 25, 2018

Related U.S. Application Data

(60) Provisional application No. 62/365,816, filed on Jul. 22, 2016.

(51) Int. Cl.
*A61H 3/02* (2006.01)

(52) U.S. Cl.
CPC ... *A61H 3/0277* (2013.01); *A61H 2003/0216* (2013.01); *A61H 2003/0283* (2013.01);
(Continued)

(58) Field of Classification Search
CPC ..... A61H 3/02; A61H 3/0277; A61H 2003/0283; F16F 2236/045
(Continued)

(56) References Cited

U.S. PATENT DOCUMENTS 1,137,008 A 4/1915 Kindermann
1,241,815 A 10/1917 Blackard
(Continued)

FOREIGN PATENT DOCUMENTS

JP 4006086793 A 3/1994
JP 2000126253 A 5/2000
(Continued)

OTHER PUBLICATIONS

PCT Application No. PCT/US2008/050707, Written Opinion & Search Report, dated Sep. 3, 2008, 12 pages.
(Continued)

*Primary Examiner* — David R Dunn
*Assistant Examiner* — Danielle Jackson
(74) *Attorney, Agent, or Firm* — Patterson Thuente Pedersen, P.A.

(57) ABSTRACT

A rotatable shock absorber assembly for a crutch. A guide pin is removably fixable within the upper portion of a support leg. A piston comprises a flange arranged proximate a saddle, comprising a top surface having two or more arcuate rotation grooves defined therein, and a main body defining an elongate slot enabling the guide pin to be inserted therethrough, such that the piston can translate along the elongate axis relative to the guide pin. A joint, can operably couple the piston to the saddle. The joint can rotate about the elongate axis relative to the piston. A biasing mechanism is configured to urge the piston along the elongate axis toward the armpit of the user whereby the saddle can be held stable in the armpit of the user and the support leg can rotate about, and translate along the elongate axis during use.

10 Claims, 15 Drawing Sheets

(52) U.S. Cl.
CPC ..... *A61H 2201/0192* (2013.01); *A61H 2201/1635* (2013.01)

(58) Field of Classification Search
USPC ..... 267/178
See application file for complete search history.

(56) References Cited

U.S. PATENT DOCUMENTS

| | | | |
|---|---|---|---|
| 1,652,110 | A | 12/1927 | Fullington |
| 1,673,609 | A | 6/1928 | Weis |
| 2,362,642 | A | 11/1944 | Lamb |
| 2,398,247 | A | 4/1946 | Redcliffe |
| 2,408,604 | A | 10/1946 | Brickson |
| 2,429,409 | A | 10/1947 | Eidman |
| 2,547,265 | A | 4/1951 | Hilgeman |
| 2,552,902 | A | 5/1951 | Miley et al. |
| 2,568,654 | A | 9/1951 | Neptune |
| 2,696,826 | A | 12/1954 | Davies |
| 2,707,478 | A | 5/1955 | Davies |
| 3,174,494 | A | 3/1965 | Maguire, Jr. |
| 3,269,400 | A | 8/1966 | Smith et al. |
| 3,272,210 | A | 9/1966 | Boruvka |
| 3,417,765 | A | 12/1968 | Slater et al. |
| 3,486,515 | A | 12/1969 | Chrysostomides |
| D223,378 | S | 4/1972 | Austin |
| 3,757,807 | A | 9/1973 | Manzo |
| 3,768,495 | A | 10/1973 | Smith |
| 3,947,140 | A | 3/1976 | Thomas |
| 4,061,347 | A | 12/1977 | Stern |
| 4,062,372 | A | 12/1977 | Slusher |
| 4,196,742 | A | 4/1980 | Owen |
| D268,456 | S | 4/1983 | Oleniak et al. |
| 4,493,334 | A | 1/1985 | Semanchik et al. |
| 4,597,589 | A | 7/1986 | Fujii et al. |
| 4,625,743 | A | 12/1986 | Harker |
| 4,630,626 | A | 12/1986 | Urban |
| 4,637,414 | A | 1/1987 | Urban |
| D288,143 | S | 2/1987 | Scott |
| 4,711,261 | A | 12/1987 | Rosenberg |
| 4,763,680 | A | 8/1988 | Acosta, Sr. |
| 4,775,168 | A | 10/1988 | Dalebout |
| 4,899,771 | A | 2/1990 | Wilkinson |
| 4,941,497 | A | 7/1990 | Prather et al. |
| 4,958,650 | A | 9/1990 | Dale |
| D318,366 | S | 7/1991 | Goldstein et al. |
| 5,058,923 | A | 10/1991 | Dale |
| 5,085,487 | A | 2/1992 | Weingartner et al. |
| 5,103,850 | A | 4/1992 | Davis |
| 5,197,501 | A | 3/1993 | Ragatz |
| 5,201,334 | A | 4/1993 | Tseng |
| 5,287,870 | A | 2/1994 | Rhodes |
| 5,295,499 | A | 3/1994 | Stutz |
| 5,301,704 | A | 4/1994 | Brown |
| 5,318,058 | A | 6/1994 | Zimmerman |
| 5,328,205 | A | 7/1994 | Bacharach |
| 5,329,954 | A | 7/1994 | Miyoshi |
| 5,331,989 | A | 7/1994 | Stephens |
| 5,336,708 | A | 8/1994 | Chen |
| 5,337,771 | A | 8/1994 | Berges et al. |
| 5,339,850 | A | 8/1994 | Mertz |
| 5,349,977 | A | 9/1994 | Wood |
| 5,409,029 | A | 4/1995 | Davis |
| 5,458,145 | A | 10/1995 | Davis |
| 5,482,070 | A | 1/1996 | Kelly |
| 5,482,072 | A | 1/1996 | Cimino |
| D369,663 | S | 5/1996 | Gostine |
| 5,564,451 | A | 10/1996 | Hagberg |
| 5,566,700 | A | 10/1996 | Brown |
| 5,571,065 | A | 11/1996 | Buiton |
| 5,575,299 | A | 11/1996 | Bieri |
| 5,606,985 | A | 3/1997 | Battiston et al. |
| 5,633,286 | A | 5/1997 | Chen |
| D382,104 | S | 8/1997 | Stefanelli et al. |
| 5,671,765 | A | 9/1997 | Hagberg, Jr. |
| D384,851 | S | 10/1997 | Heginbottom |
| 5,725,005 | A | 3/1998 | Yamasaki et al. |
| D394,148 | S | 5/1998 | Hosick |
| 5,848,603 | A | 12/1998 | Urban |
| 5,865,180 | A | 2/1999 | Sigfrid |
| 5,954,074 | A | 9/1999 | Mattson |
| 5,964,385 | A | 10/1999 | Simon |
| 6,059,368 | A | 5/2000 | Stumpf et al. |
| 6,070,907 | A | 6/2000 | Bujold et al. |
| 6,085,766 | A | 7/2000 | Geary |
| 6,142,527 | A | 11/2000 | Lenhart |
| 6,164,305 | A | 12/2000 | Herman |
| 6,186,487 | B1 | 2/2001 | Kesinger |
| D443,132 | S | 6/2001 | Jones |
| 6,279,591 | B1 | 8/2001 | Obitts |
| 6,286,529 | B1 | 9/2001 | Olivera |
| D449,043 | S | 10/2001 | Chow |
| 6,338,354 | B1 | 1/2002 | Alexander |
| 6,378,541 | B1 | 4/2002 | Matthews |
| 6,401,738 | B1 | 6/2002 | Alexander |
| 6,460,891 | B1 | 10/2002 | Jones |
| D466,749 | S | 12/2002 | O'Quinn |
| 6,491,323 | B1 | 12/2002 | Kustritz |
| 6,494,919 | B1 | 12/2002 | Matthews |
| D476,148 | S | 6/2003 | Horton |
| 6,637,773 | B1 | 10/2003 | Trinen et al. |
| D481,531 | S | 11/2003 | Haythornthwaite |
| 6,644,328 | B1 | 11/2003 | Lenhart |
| 6,772,778 | B2 | 8/2004 | Morosini et al. |
| 6,851,438 | B2 | 2/2005 | Battiston |
| 6,938,630 | B2 | 9/2005 | Perner |
| 6,959,716 | B1 | 11/2005 | Schrader |
| 6,988,745 | B2 | 1/2006 | Trinen et al. |
| D515,802 | S | 2/2006 | Grierson et al. |
| D516,295 | S | 3/2006 | Davis |
| 7,047,990 | B2 | 5/2006 | Zambrano et al. |
| 7,059,674 | B2 | 6/2006 | Garland et al. |
| 7,104,271 | B2 | 9/2006 | Larson et al. |
| D531,399 | S | 11/2006 | Olerud |
| D539,523 | S | 4/2007 | Wu |
| 7,222,633 | B1 | 5/2007 | Werner, III |
| D552,245 | S | 10/2007 | Davis |
| 7,322,612 | B2 | 1/2008 | Trinen et al. |
| 7,357,139 | B2 | 4/2008 | Bonin, Jr. |
| 7,360,547 | B2 | 4/2008 | Carlson |
| 7,383,848 | B2 | 6/2008 | Kowsky |
| 7,422,025 | B1 | 9/2008 | Waldstreicher et al. |
| 7,434,592 | B2 | 10/2008 | Larson et al. |
| 7,445,016 | B1 | 11/2008 | Ortiz |
| 7,537,017 | B2 | 5/2009 | Baker |
| D600,002 | S | 9/2009 | Fulkerson |
| 7,591,275 | B2 | 9/2009 | Baker |
| 7,621,288 | B2 | 11/2009 | Evans |
| 7,654,275 | B2 | 2/2010 | Ewell et al. |
| 7,712,478 | B2 * | 5/2010 | Gibbons ..... A61H 3/02 135/66 |
| 7,712,479 | B2 | 5/2010 | Sundarrao |
| 7,717,123 | B2 | 5/2010 | Weber et al. |
| D622,497 | S | 8/2010 | Branton |
| D625,510 | S | 10/2010 | Muller et al. |
| 7,882,847 | B2 | 2/2011 | Coe |
| 7,891,708 | B2 | 2/2011 | Panizza |
| 7,896,013 | B2 | 3/2011 | Lerner |
| 7,926,498 | B2 | 4/2011 | Weber et al. |
| 7,926,499 | B2 | 4/2011 | Weber et al. |
| D644,831 | S | 9/2011 | Smith |
| D654,682 | S | 2/2012 | White |
| 8,342,196 | B2 | 1/2013 | Weber et al. |
| 8,418,706 | B2 | 4/2013 | Weber et al. |
| D688,863 | S | 9/2013 | White |
| D689,304 | S | 9/2013 | Tang |
| D691,364 | S | 10/2013 | White |
| D750,884 | S | 3/2016 | Weber |
| D774,745 | S | 12/2016 | Weber |
| 9,517,174 | B2 | 12/2016 | Weber et al. |
| 2001/0032662 | A1 | 10/2001 | Battiston |
| 2002/0144723 | A1 | 10/2002 | Zulla et al. |
| 2004/0144410 | A1 | 7/2004 | Cheng et al. |
| 2004/0163693 | A1 | 8/2004 | Uemura |
| 2004/0206384 | A1 | 10/2004 | Zambrano et al. |

(56) References Cited

U.S. PATENT DOCUMENTS

| | | | |
|---|---|---|---|
| 2004/0226593 | A1 | 11/2004 | Robitaille et al. |
| 2004/0250845 | A1 | 12/2004 | Rudin et al. |
| 2005/0076940 | A1 | 4/2005 | Larson et al. |
| 2006/0081280 | A1 | 4/2006 | Fair |
| 2006/0090783 | A1 | 5/2006 | King-Fai |
| 2006/0124163 | A1 | 6/2006 | Tu |
| 2006/0260664 | A1 | 11/2006 | Kowsky |
| 2007/0006906 | A1 | 1/2007 | Coe |
| 2007/0131264 | A1 | 6/2007 | DeMay et al. |
| 2007/0144567 | A1 | 6/2007 | Haslach, Jr. et al. |
| 2008/0035192 | A1 | 2/2008 | Baker |
| 2008/0053502 | A1 | 3/2008 | Tseng |
| 2008/0163914 | A1 | 7/2008 | Weber et al. |
| 2008/0169011 | A1 | 7/2008 | Ewell et al. |
| 2008/0169635 | A1 | 7/2008 | Panizza |
| 2008/0283103 | A1 | 11/2008 | Jacobs et al. |
| 2008/0314426 | A1 | 12/2008 | Estrada, Jr. |
| 2009/0114257 | A1 | 5/2009 | Sutton |
| 2009/0159106 | A1 | 6/2009 | Schulz et al. |
| 2009/0235966 | A1 | 9/2009 | Birnbaum |
| 2009/0250088 | A1* | 10/2009 | Gibbons ..... A61H 3/02 135/73 |
| 2009/0266392 | A1 | 10/2009 | Campbell |
| 2010/0024857 | A1 | 2/2010 | Larson |
| 2010/0051077 | A1 | 3/2010 | McGann et al. |
| 2010/0071739 | A1 | 3/2010 | Cho |
| 2010/0186790 | A1 | 7/2010 | Weber et al. |
| 2010/0186791 | A1 | 7/2010 | Weber et al. |
| 2010/0200030 | A1 | 8/2010 | Yefimov |
| 2010/0206348 | A1 | 8/2010 | Markou |
| 2010/0229903 | A1 | 9/2010 | Ozuna et al. |
| 2010/0269872 | A1 | 10/2010 | Tharp |
| 2010/0288319 | A1 | 11/2010 | Luo |
| 2011/0005559 | A1 | 1/2011 | Daily |
| 2011/0073144 | A1 | 3/2011 | Goldberg et al. |
| 2011/0073145 | A1 | 3/2011 | Goldberg et al. |
| 2011/0108075 | A1 | 5/2011 | Weber |
| 2011/0168218 | A1 | 7/2011 | Weber et al. |
| 2012/0318313 | A1 | 12/2012 | Dickerson, II |
| 2013/0098412 | A1 | 4/2013 | Weber |
| 2013/0180558 | A1 | 7/2013 | Weber et al. |
| 2013/0199586 | A1 | 8/2013 | Van Den Driesche |
| 2014/0326285 | A1 | 11/2014 | Cappiello Rodriguez et al. |
| 2017/0181918 | A1 | 6/2017 | Weber et al. |

FOREIGN PATENT DOCUMENTS

| | | | |
|---|---|---|---|
| JP | 2003111807 | A | 4/2003 |
| JP | 2004173916 | A | 6/2004 |
| WO | WO 82/02490 | A1 | 8/1982 |
| WO | WO 2004/047706 | A2 | 6/2004 |
| WO | WO 2008/010346 | A1 | 1/2008 |
| WO | WO 2008/086459 | A2 | 7/2008 |
| WO | WO 2010/017566 | A2 | 2/2010 |
| WO | WO 2011/060178 | A1 | 5/2011 |
| WO | WO 2013/059689 | A2 | 4/2013 |
| WO | WO 2018/018040 | A1 | 1/2018 |

OTHER PUBLICATIONS

PCT Application No. PCT/US2010/056393, Written Opinion & Search Report, dated May 3, 2011, 13 pages.
PCT Application No. PCT/US2012/061153, Written Opinion & Search Report, dated Sep. 16, 2013, 8 pages.
PCT Application No. PCT/US2017/043506, Written Opinion and Search Report, dated Oct. 25, 2017, 10 pages.
Application and File History for U.S. Appl. No. 11/621,893, filed Jan. 10, 2007, now U.S. Pat. No. 7,717,123. Inventors Weber et al.
Application and File History for U.S. Appl. No. 12/754,115, filed Apr. 5, 2010, now U.S. Pat. No. 7,926,499. Inventors Weber et al.
Application and File History for U.S. Appl. No. 12/754,136, filed Apr. 5, 2010, now U.S. Pat. No. 7,926,499. Inventors Weber et al.
Application and File History for U.S. Appl. No. 13/052,703, filed Mar. 21, 2011, now U.S. Pat. No. 8,342,196. Inventors Weber et al.
Application and File History for U.S. Appl. No. 13/729,860, filed Dec. 28, 2012, now U.S. Pat. No. 9,517,174. Inventors Weber et al.
Application and File History for U.S. Appl. No. 15/375,731, filed Dec. 12, 2016. Inventors Weber et al.
Application and File History for U.S. Appl. No. 12/944,330, filed Nov. 11, 2010, now U.S. Pat. No. 8,418,706. Inventor Weber.
Application and File History for U.S. Appl. No. 13/656,335, filed Oct. 19, 2012. Inventor Weber.
Application and File History for U.S. Appl. No. 29/477,334, filed Dec. 20, 2013, now U.S. Design Pat. No. D750,884. Inventor Weber.
Application and File History for Design U.S. Appl. No. 29/477,340, filed Dec. 20, 2013, now U.S. Design Pat. No. D774,745. Inventor Weber.
EP Application No. 08727509.5, Communication Pursuant to Article 94(3) EPC, dated Sep. 3, 2014, 5 pages.
EP Application No. 08727509.5, Communication Pursuant to Article 94(3) EPC, dated Jun. 5, 2012, 6 pages.
AU Application No. 2008204869, First Examination Report, dated Jul. 10, 2012, 5 pages.
CN Application No. 200880006045.2, Second Office Action, dated Aug. 15, 2011, 8 pages.
CN Application No. 200880006045.2, First Office Action, dated Dec. 2, 2010, 15 pages.
CN Application No. 200880006045.2, Response to Second Office Action, dated Oct. 31, 2011, 17 pages.
EP Application No. 08727509.5, Response to Communication Pursuant to Article 94(3), dated Dec. 5, 2012, 26 pages.
IN Application No. 2855/KOLNP/2009, First Examination Report, dated Mar. 22, 2017, 8 pages.
JP Application No. 2009-545672, Notice of Allowance, dated May 29, 2012, 10 pages.

* cited by examiner

BIOMECHANICAL AND ERGONOMICAL ADJUSTABLE CRUTCH

RELATED APPLICATION

This application claims the benefit of U.S. Provisional Application No. 62/365,816 filed Jul. 22, 2016, which is hereby fully incorporated herein by reference.

TECHNICAL FIELD

This invention pertains to medical devices for ambulatory assistance such as crutches, and more particularly to improvements to the stability and durability of biomechanically and ergonomically designed adjustable crutches.

BACKGROUND

Most crutches are not appropriately designed for either biomechanical considerations (the way in which the crutch supports and transfers loads during operation) or ergonomic considerations (the way in which the crutch fits the anatomy of a user). The biomechanically derived adjustable crutch described in U.S. Pat. No. 7,717,123 to Weber et al. (the disclosure of which is incorporated by reference herein) discloses an adjustable crutch that is both biomechanically appropriate and ergonomically comfortable for the user. This biomechanically derived crutch includes a support leg that is curved both forwardly in a side-view plane and outwardly in a front-view plane with a cantilevered handle angularly offset from both the front-view plane and as horizontal plane. The biomechanically derived crutch further includes an upper portion with a saddle for positioning under the arm that can both pivot from front to back and side to size, and can move vertically. The lower portion has a foot member that is oriented perpendicular to the floor when the crutch is in a resting position.

Although the design of this biomechanically derived crutch presents a significant advance in terms of both proper functionality and improved comfort of the crutch, the need for the crutch to be adjustable to accommodate different user heights and the moveable nature of the saddle relative to the support leg has presented design challenges in making the crutch both stable and durable, especially over extended periods of use. Accordingly, there is a continuing need for improvements to a biomechanically derived crutch which can address these challenges.

SUMMARY

An improved biomechanical and ergonomic adjustable crutch in accordance with various embodiments enhances the stability and durability of the crutch with various improvements that make the improved crutch quieter, more durable, and more stable. The biomechanical and ergonomic adjustable crutch includes a support leg that is curved both forwardly in a side-view (median/sagittal plane) and outwardly in a front-view (frontal/coronal plane) with a cantilevered handle angularly offset from each of a frontal/coronal plane, a median/sagittal plane, and a transverse/axial plane, and a foot member that is oriented perpendicular to the floor when the crutch is in a resting position.

In some embodiments, a saddle for positioning under the arm of the user is operably connected to an upper portion of the support leg of the crutch by a rotatable shock absorber assembly that is both horizontally pivotable and vertically moveable on a spring-loaded, internally positioned piston that is entirely inside of an upper portion of the support leg. In various embodiments, the internally positioned piston provides for both greater stability and durability of the shock absorber assembly in response to both vertical and rotation movement. In some embodiments, an upper portion and a lower portion slidingly interface with a middle portion of the support leg. A plurality of apertures and corresponding spring-loaded frusto-conical adjustment pin(s) in the portions may be selectively actuated to adjust a relative height of the portions of the support leg based on the apertures that the adjustment pin(s) engages. The various embodiments, the adjustment pin(s) have a conical angle that provides for less vertical play between the corresponding portions of the support leg and quieter operation, especially in response to a transfer of weight carried by the support leg during use of the crutch.

Embodiments provide a rotatable shock absorber assembly for a crutch. The shock absorber assembly can comprise a guide pin that is removably fixable within the upper portion of the support leg and extends along an axis orthogonal to the elongate axis. A piston can comprise a flange proximate the saddle with a top surface having two or more arcuate rotation grooves defined therein. In some embodiments, the flange has a size and shape inhibiting the entry of the flange into the upper portion of the support leg.

The main body of the piston can be slideably arrangable within the upper portion of the support leg define an elongate slot through which the guide pin can be inserted such that the piston can translate along the elongate axis relative to the guide pin. A joint can operably couple the piston to the saddle. The joint can comprise two or more rotation pins, each slidably insertable within a respective one of the two or more arcuate rotation grooves such that the joint can rotate about the elongate axis relative to the piston. In embodiments a piston washer, which can be copper, is arrangable at a bottom face of the joint.

A biasing mechanism can be configured to urge the piston along the elongate axis toward the armpit of the user. In embodiments, the saddle can be held stable in the armpit of the user and the support leg can rotate about, and translate along the elongate axis during use. The extent of the translation of the piston relative to the guide spring can be limited by the length of the slot along the elongate axis.

In some embodiments, the biasing mechanism comprises a block fixedly arranged within the upper portion of the support leg at a position distal to the saddle relative to the piston and a compression spring arranged between the block and the piston. The block can comprise an upwardly extending spring pin which is receivable within one or more lower coils of the spring. The piston can comprise a downwardly extending block stem receivable within one or more upper coils of the spring.

In embodiments, the joint is tiltably coupled to the saddle such that the saddle can remain fixed within the armpit of the user while the support leg is pivoted between the front side of the user and the back side of the user.

In one embodiment, the rotatable shock absorber assembly is incorporated within a crutch having a first side direction generally parallel to a walking direction of a user, a second side direction opposite the first side direction, a third side direction perpendicular to the first side direction and a fourth side direction opposite the third side direction. The crutch can also comprise a saddle, extending in an elongate shape between the first side direction and the second side direction. The saddle can include an inner lobe configured to rest against a torso of the user during use, an outer lobe configured to rest against an arm of the user during use, and a top portion connecting the inner lobe and the outer lobe and forming a U-shaped channel having an curved upper surface configured to fit within an armpit of the user with the U-shaped channel open along at least a portion of a downward facing side. The crutch can have a support leg pivotably connected to the saddle at the a rotatable shock absorber assembly, wherein the joint is disposed within the U-shaped channel. The saddle can be held stable in the armpit of the user and the support leg can rotate about, and translate along the elongate axis during use.

In one embodiment, the rotatable shock absorber assembly is incorporated within a crutch having a first side direction generally parallel to a walking direction of a user, a second side direction opposite the first side direction, a third side direction perpendicular to the first side direction and a fourth side direction opposite the third side direction. The crutch can also comprise a support leg having a top end and a bottom end. The support leg can also comprise a bottom portion proximate the bottom end, a middle portion disposed to the first side direction of an axis extending between the top end and the bottom end, and disposed to the third side direction of the axis extending between the top end and the bottom end, and a top portion proximate the top end extending along an elongate axis.

In embodiments, a cantilevered handle can extend in an elongate shape from a fixed end arranged at the middle portion of the support leg to a free end. The crutch can also comprise a saddle coupled to the top end of the support leg by the rotatable shock absorber assembly.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures.

Figure 1:
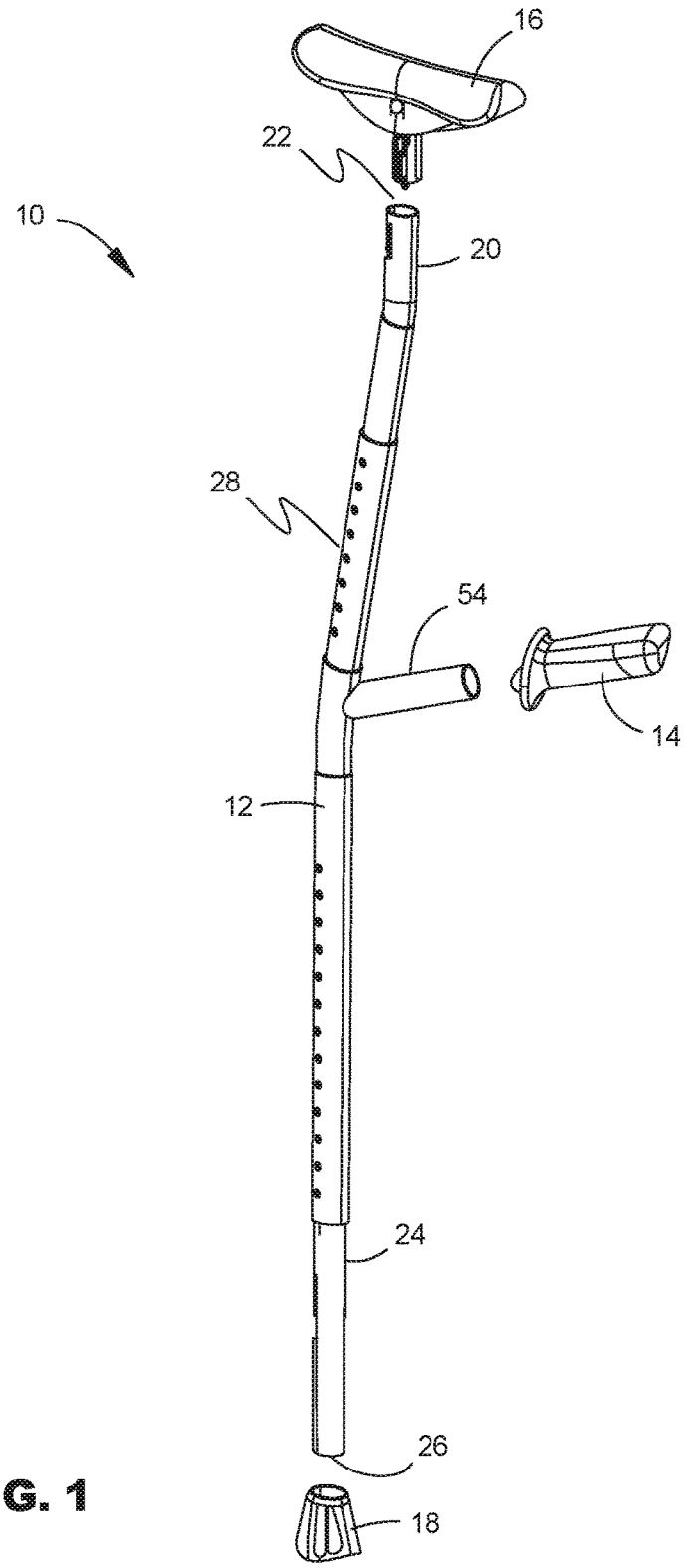
FIG. 1 is an exploded perspective view depicting a crutch, according to an embodiment.

Dimensions provided in drawings are examples only. Unless otherwise stated, dimensions in drawings are provided in millimeters. While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE EMBODIMENTS

An example of an improved crutch 10, shown in FIG. 1, includes an elongate support leg 12 having a cantilevered handle 14 disposed thereon with a saddle 16 connected to an upper portion 20 of the support leg 12 at a top end 22 of the crutch 10, and a foot 18 connected to a lower portion 24 of the support leg 12 at a bottom end 26 of the crutch 10. Crutch 10 is a handed crutch and is configured for optimal use with a particular hand and side of the body. The particular crutch 10 shown is a left-handed crutch, but references to crutch 10 should not be understood as limited to a crutch of a particular handedness. A right-handed crutch is omitted for the sake of simplicity in this figure, but it should be understood that the discussion herein is applicable to right-handed crutches, which are contemplated and which are in a mirror image of their left-handed counterparts as shown, for example, in FIG. 2A and 2B. Further, the crutches disclosed herein may and often will be packaged in a set including a left-handed crutch and a right-handed crutch. Still further, some embodiments and features are not limited to handed crutches and may be used in conjunction with crutches or other devices that are equally suited to use with either hand.

Figure 2B:
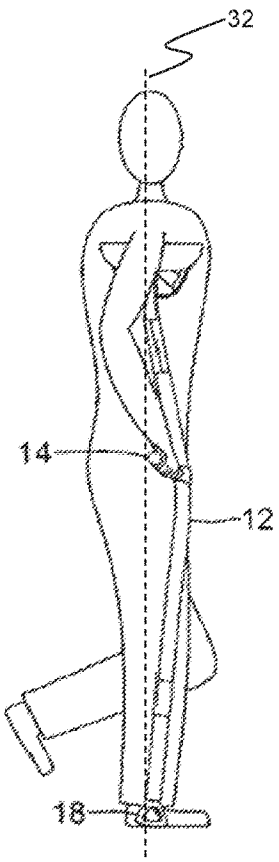
FIG. 2B is a side view depicting a pair of crutches in use, according to an embodiment.
Figure 2A:
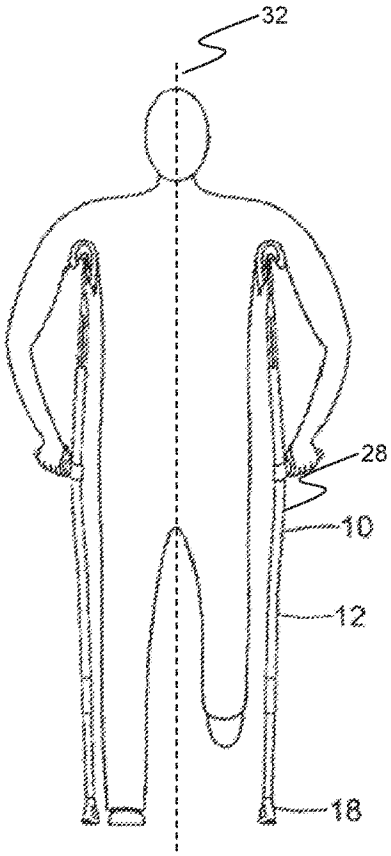
FIG. 2A is a front view depicting a pair of crutches in use, according to an embodiment.
Figure 3B:
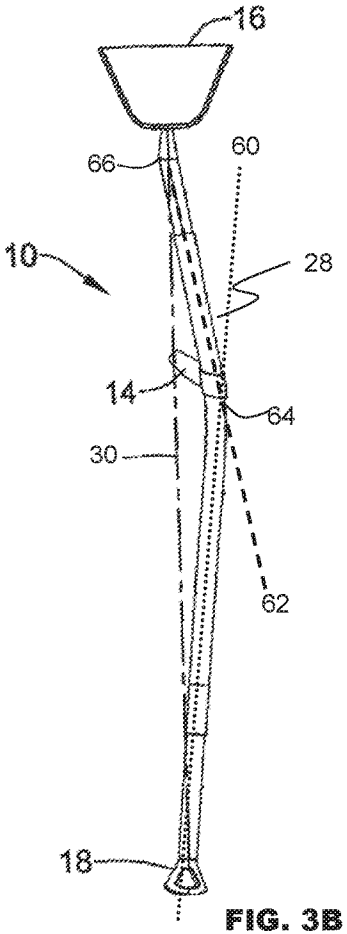
FIG. 3B is a side view depicting a crutch, according to an embodiment.
Figure 3A:
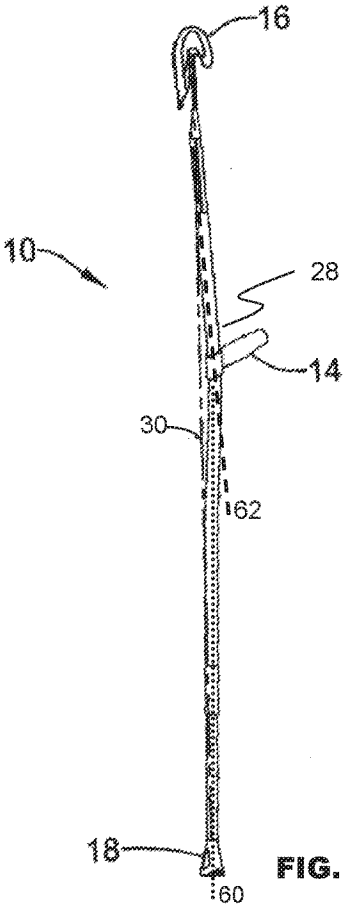
FIG. 3A is a front view depicting a crutch, according to an embodiment.

The elongate support leg 12 may be understood better with reference to FIG. 2A and 2B, which are front and side views showing a pair of crutches in use, as well as with reference to FIG. 3A and 3B which depict front-views and side views of a single crutch. Support leg 12 may be shaped to accommodate a narrower stance width, which eases mobility in crowded areas and cramped areas. In the embodiment shown, a middle portion 28 of support leg 12 arcs outwardly to the side to accommodate the hip area and then arcs back in to narrow the stance of the crutch 10 at the lower portion 24 that includes the foot 18. In other words, the middle portion 28 of support leg 12 is curved in the anatomical planes of the user outwardly in a frontal/coronal plane to an outer side of a median/sagittal plane.

In some embodiments, a crutch axis (shown by phantom line 30) extending between the top end 22 and the bottom end 26 of crutch 10 is not perfectly vertical in a resting, neutral position, but is at a small forward angle such that the bottom end 26 of support leg 12 is in front of a frontal/coronal plane relative to an anatomical central axis of the user (shown by phantom line 32), with the middle portion 28 of support leg 12 further in front of the bottom end 26. In other words, the support leg 12 is curved forwardly in a side-view (median/sagittal plane) with the bottom end 26 slightly forward of the top end 22. In various embodiments, the forward curve of the support leg 12 is such that, in addition to the middle portion 28 being further forward in a side-view (median/sagittal plane), the lower portion 24 is generally oriented perpendicular to the floor when the crutch 10 is in a resting position even though the bottom end 26 at a slight angle and forward of the top end 22 of the support leg 12.

In various embodiments, lower portion 24 can be generally straight, middle portion 28 can exhibit middle bend 64, and upper portion 20 can exhibit upper bend 66.

In an example embodiment, the angles and dimensions of the portions of the support leg 12 are approximately as described below, though other angles and dimensions can be used. Lower portion 24 is generally straight, defining a lower portion axis (phantom line 60), and can have a length, in one embodiment, of about 43 cm. As assembled, middle portion 28 can extend above lower portion 24, along lower portion axis for a length of about 48 cm to middle bend 64. Above middle bend 64, middle portion 28 can extend along middle portion axis (phantom line 62) for a length of about 24 cm. Upper portion 20 can extend along middle portion axis 62 for a length of about 20 cm, to upper bend 66. Above upper bend 66, upper portion 20 can extend along crutch axis 30 for about 10 cm.

Relative to a median/sagittal plane of the user, middle bend 64 can define an angle between lower portion axis 60 and middle portion axis 62 of about 9 degrees. Relative to a transverse plane of the user, middle bend 64 define have an angle between lower portion axis 60 and middle portion axis 62 of about 2 degrees.

Relative to a median/sagittal plane of the user, bend 66 can define an angle between middle portion axis 62 and crutch axis 30 of about 170 degrees.

In various embodiments, one or both of the upper portion 20 and lower portion 24 are both slidably adjustable with respect to the middle portion 28 to fit the crutch 10 to a particular user. In some embodiments, the upper portion 20 may be adjusted first with respect to the middle portion 28 to fit the crutch 10 to an arm of user of a particular length, and the lower portion 24 may be subsequently adjusted to fit the crutch 10 to the height of a user. In various embodiments, the versatility of the crutch 10 is such that a first size of adjustable crutch can accommodate people with heights of 5'0"-6'6", a smaller, second size of adjustable crutch can accommodate people with heights of 4'0"-5'0", and a larger, third size of adjustable crutch can accommodate people with heights of 6'0"-7'0". Other sizes can be provided in embodiments.

In one embodiment of crutch 10, the upper portion 20 and the lower portion 24 are telescopically inserted into the middle portion 28. Alternatively, the middle portion 28 could be telescopically inserted into one or both of the upper portion 20 and/or lower portion 24. In various embodiments, the cross-sectional shape of these portions may be circular or optionally may be oval, oblong, or other non-circular shape to maintain the orientation of these portions with respect to each other as the relative position of each portion is adjusted.

In embodiments, such as that shown in FIGS. 4A-4D, discrete sliding adjustment of the portions 20, 24, 28 of support leg 12 relative to one another is facilitated by button connector 300. The outer portion(s) of support leg 12 can present linearly spaced pairs of apertures 301. Each aperture of each pair of apertures 301 is generally opposite around the perimeter of the outer portion(s) of support leg 12. The inner portion(s) of support leg 12 can present a single pair of adjustment apertures (not shown). Adjustment apertures can be, for example, about 5 centimeters from the end of the inner portion(s) that will be inserted into the outer portion(s). In the depicted embodiment, middle portion 28 is the outer portion into which upper portion 20 and lower portion 24 are telescopically inserted. The following description adopts this convention, but it will be clear to those of ordinary skill of the art that alternative arrangements are possible.

Each button connector 300 can be selectively depressed to retract and then released to extend button connector 300 into adjustment apertures in upper portion 20 and lower portion 24 of support leg 12. Each button connector 300 can further extend into a selected pair of apertures 301 in the middle portion 28 of support leg 12. When the button connector 300 is extended into a selected pair of apertures 301, relative movement of the two sections is prevented. The two sections may be adjusted by depressing button connector 300 and sliding one section with respect to another. The support leg 12 may further include one or more fittings such as plastic bushings (not shown) or the like that serve to guide and position the portions of the leg with respect to each other to prevent rattling and provide a solid one-piece feel.

Figure 4B:
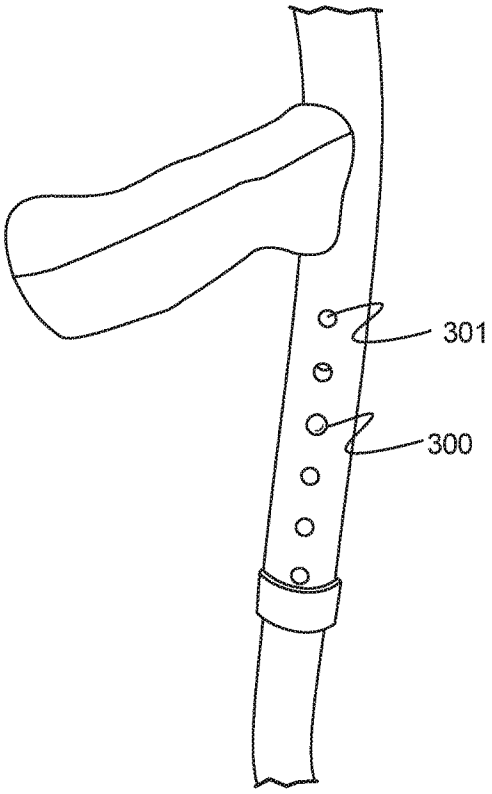
FIG. 4B is a depiction of the button connector of FIG. 4A selectively positioned within an aperture in the support leg of a crutch, according to an embodiment.
Figure 4A:
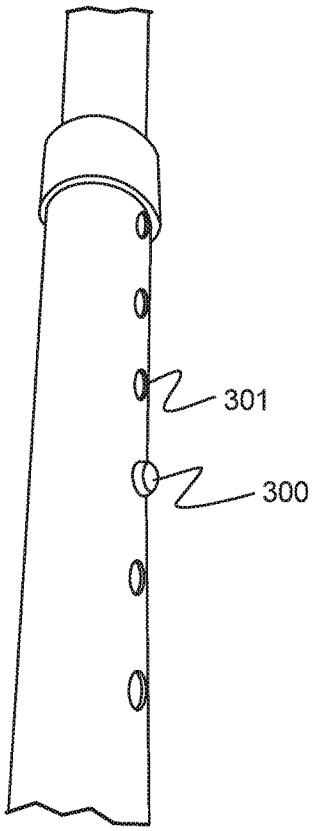
FIG. 4A is a depiction of a button connector selectively positioned within an aperture in the support leg of a crutch, according to an embodiment.
Figure 4D:
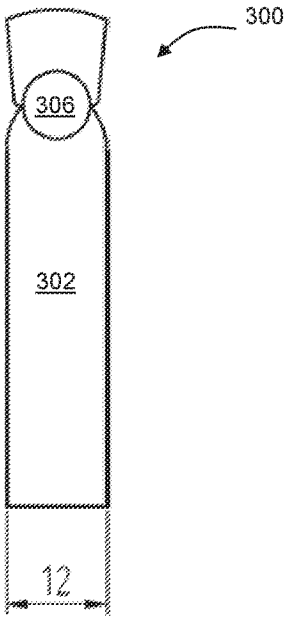
FIG. 4D is a side plan view depicting a button connector according to an embodiment.
Figure 4C:
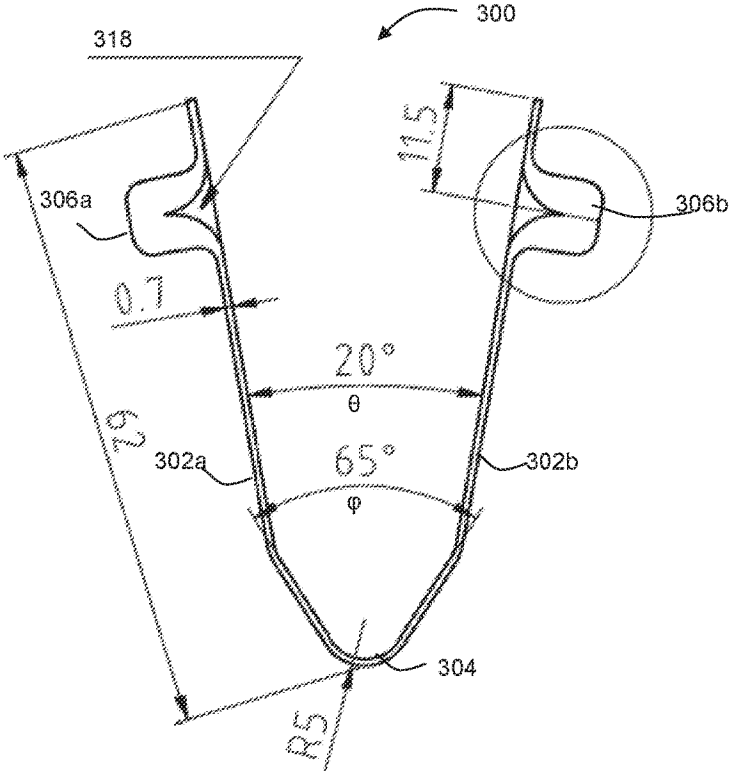
FIG. 4C is a front plan view depicting a button connector, according to an embodiment.
Figure 4E:
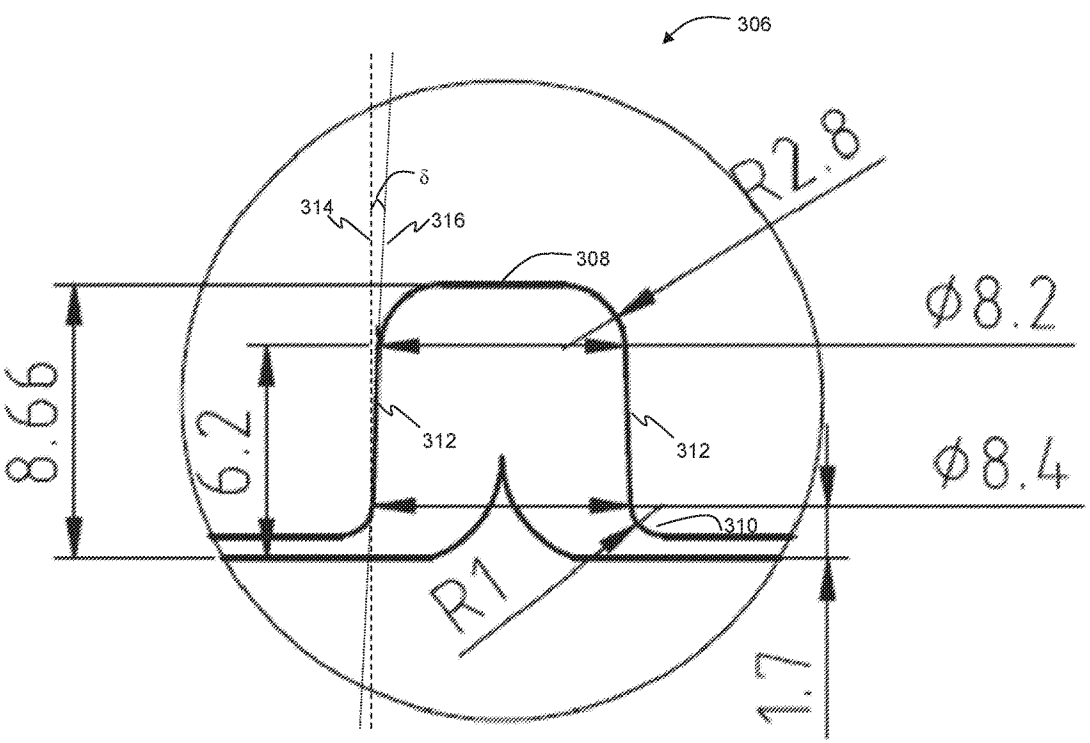
FIG. 4E is a front plan view depicting an adjustment button according to an embodiment.

FIGS. 4C-4E depict detailed views of button connector 300. Button connector 300 can present connector legs 302*a* and 302*b* joined at connector vertex 304, and presenting buttons 306*a* and 306*b* at respective ends distal to connector vertex 304. Connector legs 302*a* and 302*b* can be bent such that angle φ between portions of connector legs 302*a* and 302*b* proximate to connector vertex 304 is about sixty five degrees, and angle θ between portions of connector legs 302*a* and 302*b* proximate buttons 306*a* and 306*b* is about 20 degrees. Other angles can be used. Buttons 306*a* and 306*b* can each present notch 316. Buttons 306*a* and 306*b* can be substantially hollow, or may be filled with an elastomeric or other substance.

As depicted in further detail in FIG. 4E, buttons 306*a* and 306*b* can define generally frusto-conical forms, having a first diameter at an outer end 308 that is smaller than a second diameter at connection point 310 at connector leg 302. This frusto-conical form provides for a more secure fit between the button 306 and the corresponding aperture 301. In embodiments, first and second diameters are chosen such that the slope of button edge 312 relative to a line (phantom line 314) normal to connector leg 302 defines an angle δ that is between one degree and five degrees. In embodiments, δ can be from two degrees to three degrees. In one embodiment, δ is two and one-half degrees. The second diameter at connection point 310 can be chosen to be substantially equivalent to the diameter of each aperture 301.

Button connector 300, in concert with apertures 301 therefore allows adjustment of the working lengths of upper portion 20 and lower portion 24 of support leg 12, in order to support the varying body geometry of various users. In addition, the structure of buttons 306 reduces the amount of play between buttons 306 and apertures 301, resulting in a quieter, more secure feeling connection less bothersome "clacking" or wear on upper portion 20, lower portion 24, or buttons 306.

In an embodiment, discrete adjustment can be provided by a spring loaded adjustment pin (not shown) which can operated in a manner substantially similar to button connector 300.

Figure 5:
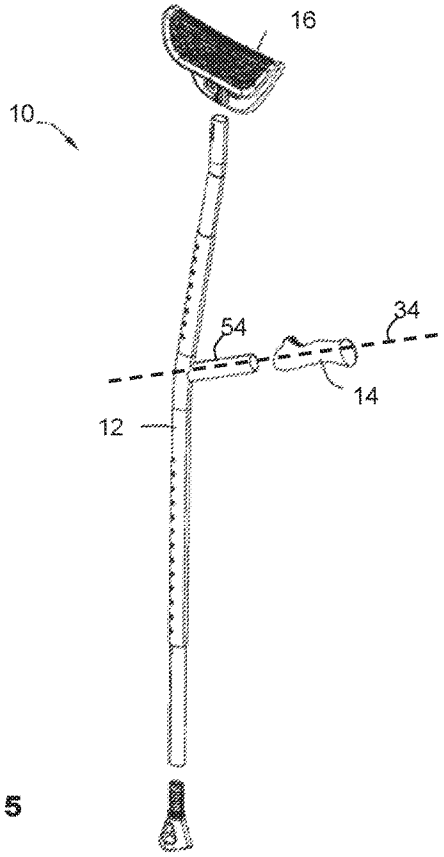
FIG. 5 is an exploded perspective view depicting a crutch, according to an embodiment.

As can be seen in FIG. 5, handle 14 is attached to the leg by sliding handle 14 over a cantilevered arm 54 fixed to the leg. It is contemplated that the cantilevered arm 54 provides most of the structural support for the handle 14, while the handle 14 is made from a non-abrasive resilient closed-cell foam or other suitable material to provide a comfortable grippable surface for the use.

In various embodiments, the angles of a center line of the handle (shown in phantom at 34) relative to the three orthogonal axis of the body of the user are about 16 degrees in the median/sagittal plane, about 60 degrees in the frontal/coronal plane, and about 45 degrees in the transverse/axial plane defined relative to the central axis of the user. Other angles may be used. The handle 14 preferably may include a fastener (not shown) such as a screw or Christmas tree fastener to fix the handle 14 to the cantilevered arm 54. Cantilevered arm 54 may include a hole (not shown) for receiving the fastener. An opening (not shown) of handle 14 may have an oval or other non-circular cross-section and cantilevered arm 54 of the leg may have a corresponding shape such that the relationship of arm 54 to the opening prevents rotation of the handle 14. Of course, other stem and cavity configurations that do not have circular profiles may also provide a similar function. Handle 14 may also include tabs on either side that extend at least partially round the sides of the vertical portion of the leg to further oppose rotational force. Handle 14 may be symmetric such that it is equally suitable for use by both a left hand and a right hand. Handle 14 may also be shaped in order to better accommodate a left or right hand.

The position and angles of handle 14 relative to crutch axis 30 allow the hand of the user to be generally positioned parallel with the crutch axis 30 with the handle angularly offset from each anatomical plane relative to the central axis 32 of the user. In various embodiments, the position and angle of the handle 14 corresponds to a natural position of the hand of the user when hanging in a resting position. This positioning of handle 14 facilitates a more natural balance to reduce effort by the user in keeping the crutch 10 from shifting forward or backward with respect to the shoulder, thereby reducing forearm fatigue and shear stress under the arm in contact with the saddle 16.

Figure 6B:
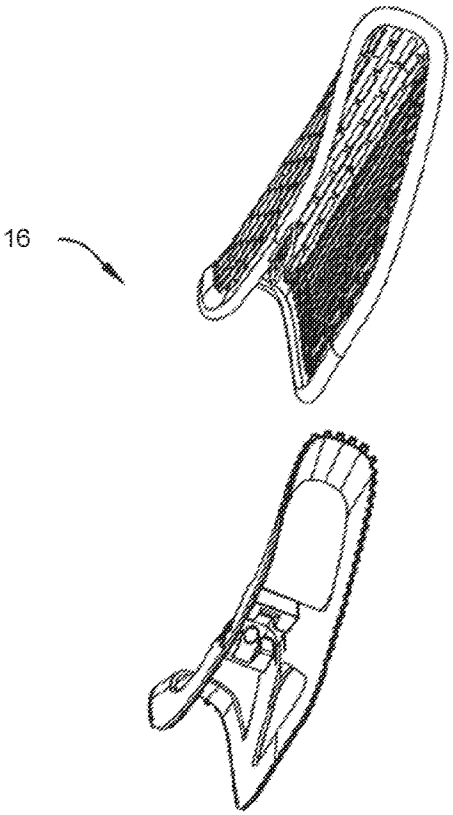
FIG. 6B is a bottom isometric exploded view depicting the saddle of a crutch of FIG. 6A.
Figure 6A:
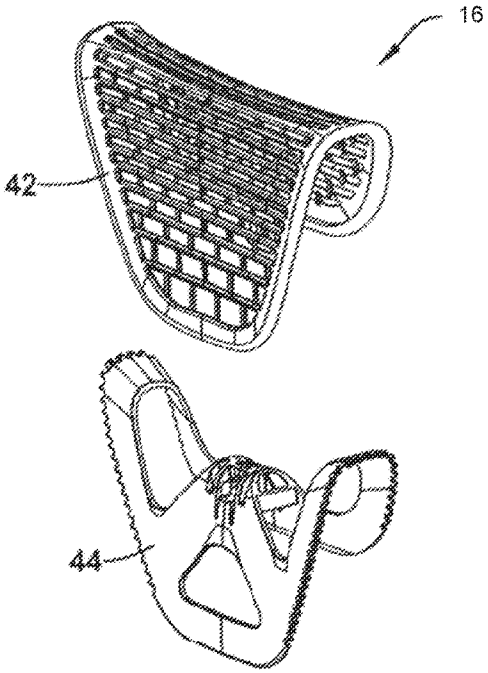
FIG. 6A is a top isometric exploded view depicting a saddle of a crutch, according to an embodiment.

FIG. 6A and 6B are exploded views depicting an embodiment of saddle 16. Saddle 16 may include an elastomeric molded member 42 that may be molded and then expanded to at least partially orient the polymeric molecules of the member 42. This member may be stretched and attached to a rigid perimeter frame 44 to provide the saddle shape. The member 42 preferably completely encloses the perimeter of frame 44 to isolate the frame from the user. Frame 44 has a hyperbolic paraboloid shape, with one lobe being larger than the other. The elastomeric molded member may include slits or other openings to allow for ventilation through the saddle. Frame 44 can present attachment features enabling attachment of rotatable shock absorber assembly 400. Other saddles, such as those described in U.S. Pat. Nos. 7,926,498 and 8,418,706 (the disclosures of which are incorporated by reference herein) may also be used.

Figure 7:
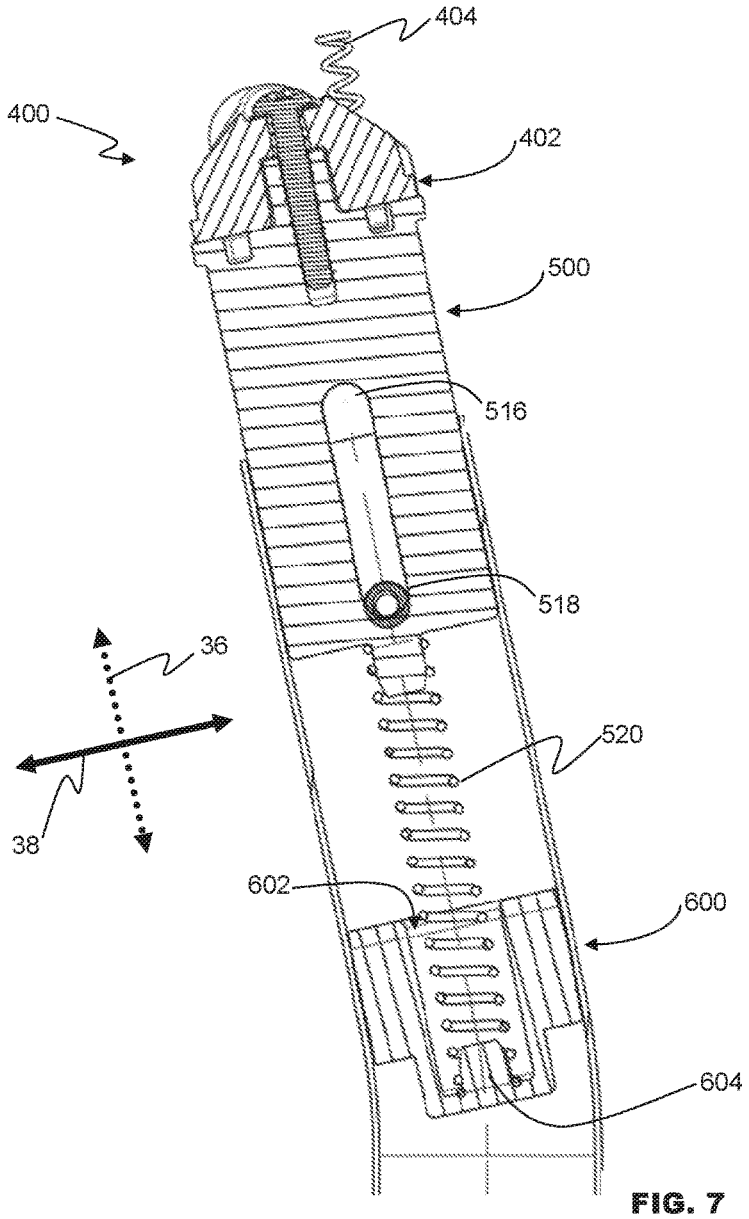
FIG. 7 is a cross-sectional view depicting a rotatable shock absorber assembly of a crutch, according to an embodiment.

In an embodiment, saddle 16 is fixedly connected to rotatable shock absorber assembly 400. FIG. 7 is a section view depicting a rotatable shock absorber assembly 400, according to an embodiment. Rotatable shock absorber assembly 400 can comprise joint 402, piston 500, and block 600. Rotatable shock absorber assembly 400 can maintain the saddle in position in the armpit of a user to help support the user and move with the user during operation while the rest of the crutch is moved back and forth with respect to the user's body. Shock absorber assembly 400 can extend along an elongate axis 36 (represented by dotted line), which can be parallel to central axis 32, crutch axis 30, or at an angle relative to both in embodiments. A radial plane, normal to elongate axis 36 can be defined by major axis 38 (represented by solid line) and minor axis 40 (represented by dashed line depicted in FIG. 11A), which are orthogonal to each other.

Figure 8A:
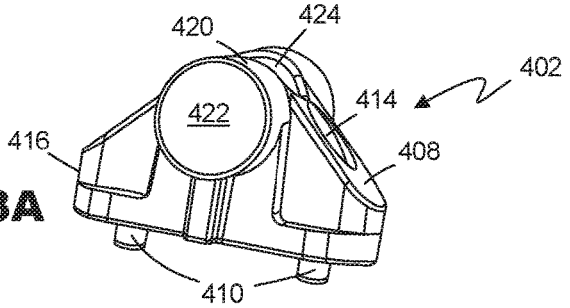
FIG. 8A is a perspective view depicting a joint for a rotatable shock absorber assembly, according to an embodiment.
Figure 8B:
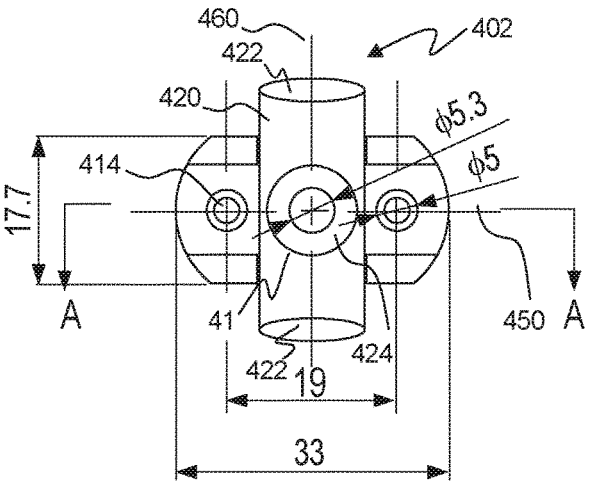
FIG. 8B is a top plan view depicting the joint of FIG. 8A, according to an embodiment.
Figure 8C:
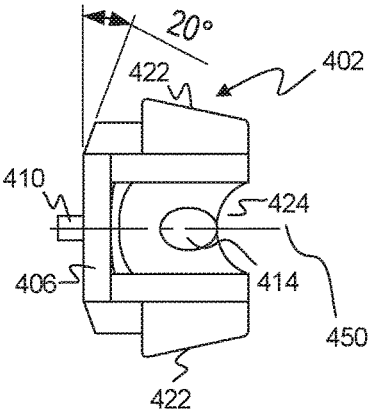
FIG. 8C is a side plan view depicting the joint of FIG. 8A, according to an embodiment.
Figure 8D:
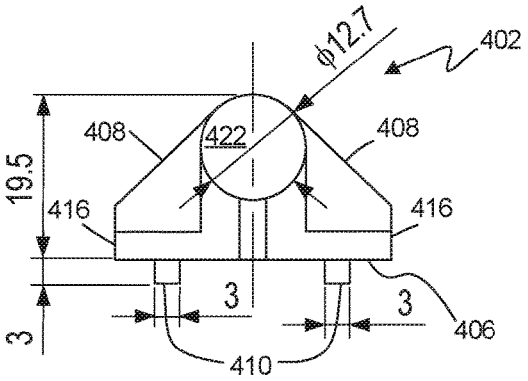
FIG. 8D is a front plan view depicting the joint of FIG. 8A, according to an embodiment.
Figure 8E:
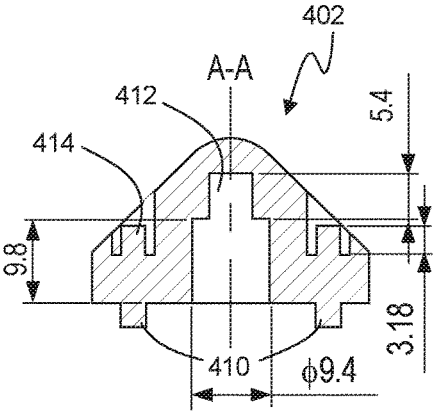
FIG. 8E is a cross-sectional view depicting the joint of FIG. 8A, according to an embodiment.

FIGS. 8A-8E are perspective views and plan views depicting an embodiment of joint 402. As can be seen in FIG. 8B, a frontal plane (parallel to elongate axis 36 and major axis 38, denoted as line 450) divides joint 402 into mirrored front and back portions. Similarly, a median plane (parallel to elongate axis 36 and minor axis 40, denoted as line 460) divides joint 402 into mirrored side portions. As seen in FIG. 8C, joint 402 includes generally rectangular bottom face 406, elongated along line 450. Joint 402 further includes generally cylindrical head portion 420, elongated along line 460. Head portion 420 can be sloped at front and rear faces 422. Head portion 420 includes centrally located circular aperture 424. Sloped side faces 408 can slope from head portion 420 towards rectangular bottom face 406. In embodiments, sloped side faces can meet vertical side faces 416. Joint 402 can present one or more rotation pins 410, which can protrude from bottom face 406. Joint 402 can further present centrally located joint bore 412. As can be seen in FIG. 8E, joint 402 can further present one or more tilt spring holders 414, which can be pins embedded into depressions within sloped side faces 408.

Figure 8F:
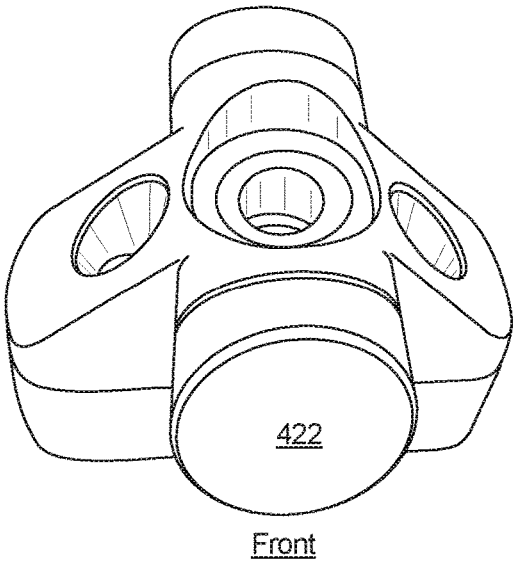
FIG. 8F is a perspective view depicting the joint for a rotatable shock absorber assembly, according to an embodiment.
Figure 8G:
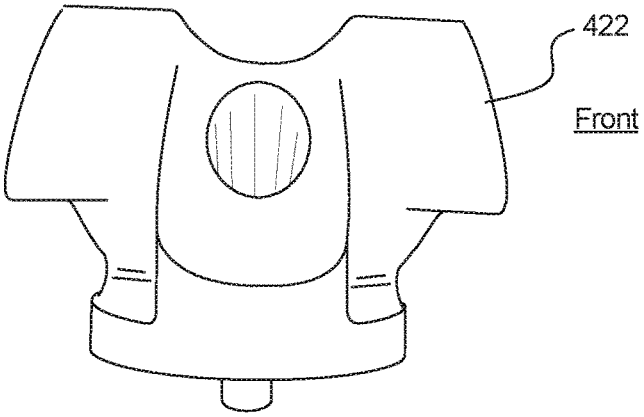
FIG. 8G is a perspective view depicting the joint for a rotatable shock absorber assembly, according to an embodiment.

Additional views of joint 402 can are provided in FIGS. 8F and 8G, which are perspective views of an embodiment. Joint 402 can comprise hard plastic, rubber, metal, or other materials. In embodiments, joint 402 can comprise resins or other polymers and can be glass fiber reinforced. Joint 402 can be cast, injection molded, 3D printed, or fabricated via other methods known in the art.

Figure 11A:
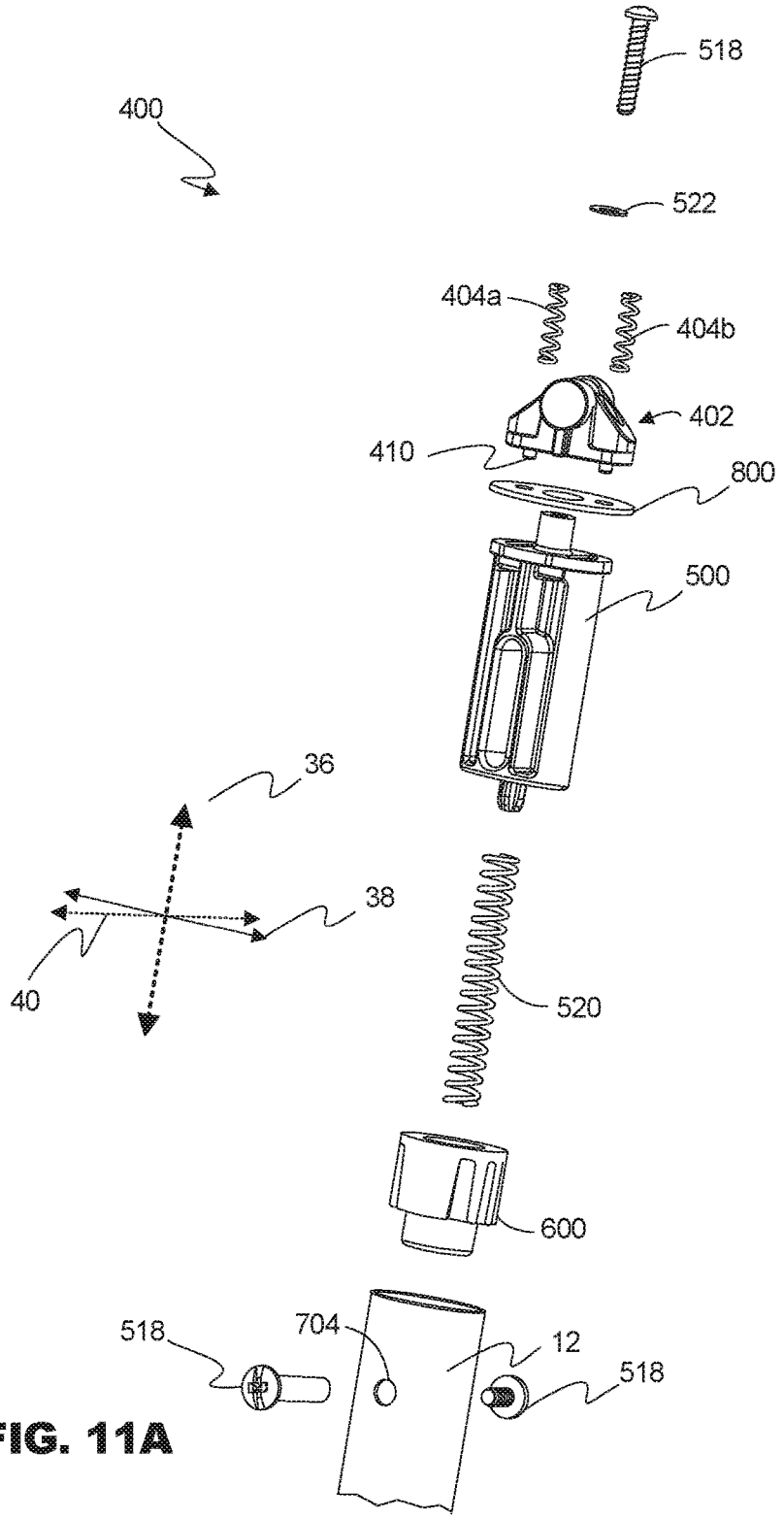
FIG. 11A is an exploded perspective view depicting a rotatable shock absorber assembly and support leg, according to an embodiment.
Figure 11B:
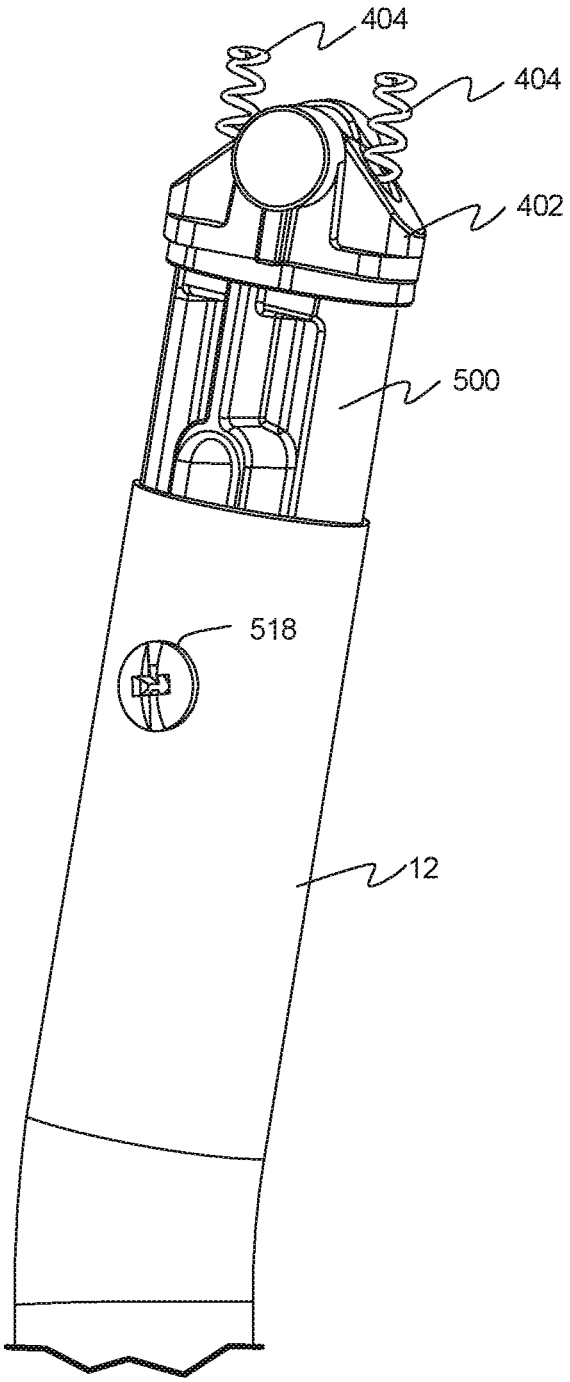
FIG. 11B is a perspective view depicting the rotatable shock absorber assembly and support leg of FIG. 11A, according to an embodiment.

One or more tilt springs 404 (depicted in FIGS. 7 and 11A-11B) can be positioned to interact between joint 402 and saddle 16, enabling saddle 16 to tilt, or pivot, on minor axis 40. In the embodiment of FIGS. 11A and 11B, two tilt springs 404*a* and 404*b* are shown, though more or fewer tilt springs can be included in embodiments. Tilt springs 404 can be compressed as saddle 16 is tilted and be configured to urge saddle 16 to a neutral position. This tilting action can allow the saddle to rock about minor axis 40 during use to reduce or eliminate scrubbing action of the saddle against the user's chest and arms. In embodiments, joint 402 can enable tilting as described while being fixed or adjustably fixed about elongate axis 36.

Figure 9A:
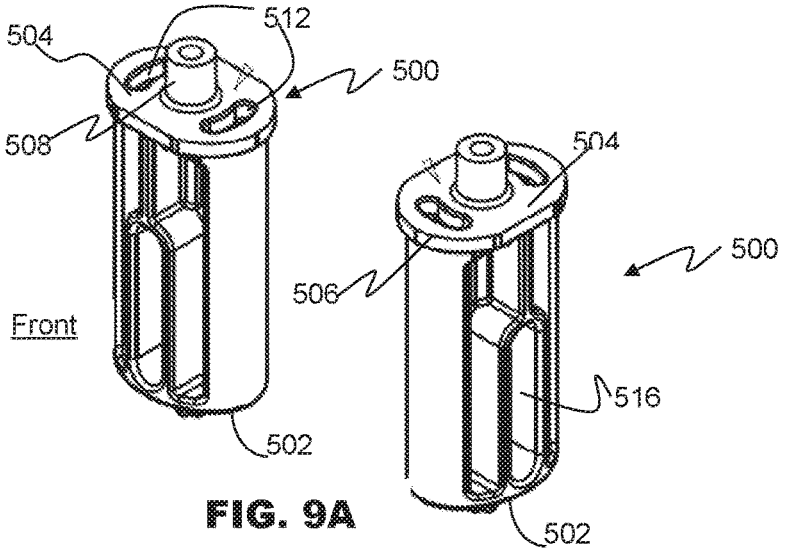
FIG. 9A is a perspective view depicting pistons for the rotatable shock absorber assembly, according to an embodiment.
Figure 9B:
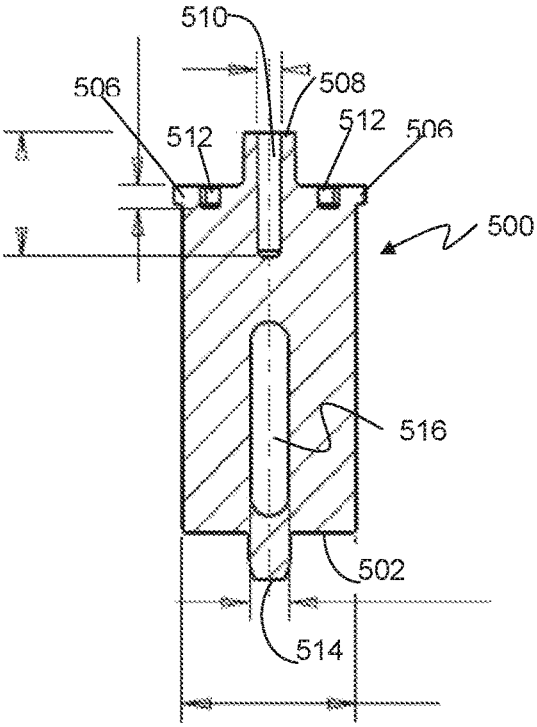
FIG. 9B is a cross-sectional view depicting a piston for the rotatable shock absorber assembly, according to an embodiment.
Figure 9C:
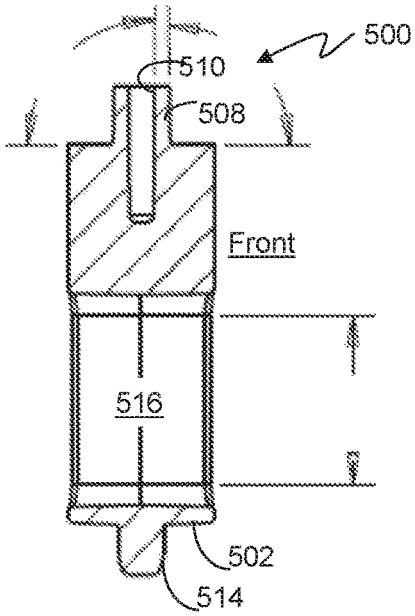
FIG. 9C is a cross-sectional view depicting a piston for the rotatable shock absorber assembly, according to an embodiment.

FIGS. 9A-9C are perspective and plan views depicting an embodiment of piston 500, according to an embodiment. The main body of of piston 500 can have a generally elliptical cross section, and extend along elongate axis 36. A bottom surface 502 can define an ellipse, elongated along major axis 38. A flange 504 can be arranged at an upper end of main body 502 and define a rectangle elongated along major axis 38 having rounded extensions 506. Extensions 506 can extend further along major axis 38 than main body 502. Piston 500 is slidably insertable into upper portion 20 of support leg 12, with the exception of flange 504. Joint stem 508 can be centrally located on flange 504 and extend upward along elongate axis 36. Joint stem 508 can have a diameter that enables insertion into joint bore 412. In embodiments this diameter can be about 7 mm. Joint stem 508 can further present screw bore 510. In embodiments, screw 518 and washer 522 (as shown in FIG. 11A) can fixably connect piston 500 to joint 402.

Flange 504 can further present rotation grooves 512, which can be apertures or depressions in the top surface. Rotation grooves 512 can have a width sufficient to enable insertion of rotation pins 410 of joint 402. Rotation grooves 512 can define total or partial arcs, enabling rotation pins 410 to move relative to piston 500, creating a rotation of joint 402 and saddle 16 relative to piston 500 around elongate axis 36. The extent of rotation may be 15, 20, 22, 25, 30, or 35 degrees or another suitable rotational extent. In one embodiment, this rotational extent is 44 degrees. This horizontal rotation allows the angular position of the saddle to be adjusted with respect to the rest of the crutch and in particular the handle, to allow the crutch to better adapt to various unique user body shapes (the armpit-to-hand angle varies between people). In another suitable embodiment joint 402 can be rotationally fixed relative to piston 500 so as to allow a user to customize the orientation of the saddle 16 with respect to the support leg 12.

Piston 500 can present piston slot 516. Piston slot 516 is elongated in a direction parallel to the main body of piston 500 through flattened faces. In embodiments, piston slot 516 allows passage of guide pin 518 through piston 500 from front to back. In other embodiments, piston slot 516 can define depressions in piston 500, without allowing through passage of a guide pin 518. Piston slot 516 can have a length suitable for allowing the desired amount of vertical (relative to the piston) movement of saddle 16. In embodiments, this length can be about 26.7 mm. Piston 500 can present centrally located block stem 514, on bottom surface. Block stem 514 can present vertical ridges.

Piston 500 can comprise hard plastic, rubber, metal, or other materials. In embodiments, piston 500 can comprise resins or other polymers and can be glass fiber reinforced. Piston 500 can be cast, injection molded, 3D printed, or fabricated via other methods known in the art.

Piston spring 520 can be a spring, metal bellows, or other appropriate store of mechanical energy. In embodiments, piston spring 520 is a metal spring with an inner diameter sufficient to enable the insertion of block stem 514.

Block 600 is generally cylindrical or elliptical with cross-section suitable for insertion into upper portion 20 of the support leg 12. As depicted in FIG. 7, block 600 can present block bore 602 which can include spring pin 604. Block bore 602 can have a diameter sufficient to enable insertion of piston spring 520, and spring pin can have a diameter sufficiently small to enable insertion into piston spring 520.

Figure 10A:
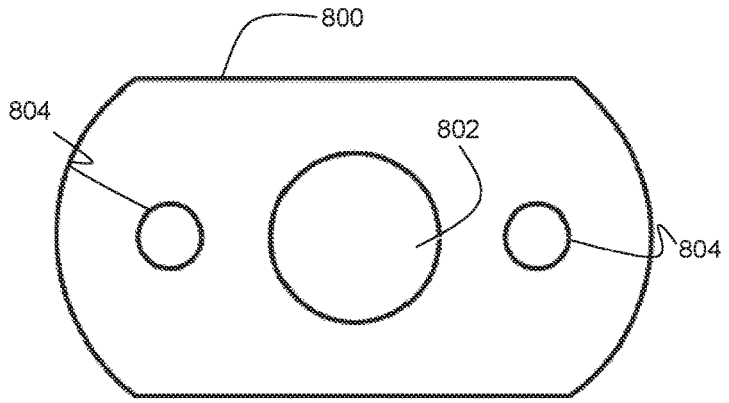
FIG. 10A is a top plan view depicting a piston washer for a rotatable shock absorber assembly, according to an embodiment.
Figure 10B:
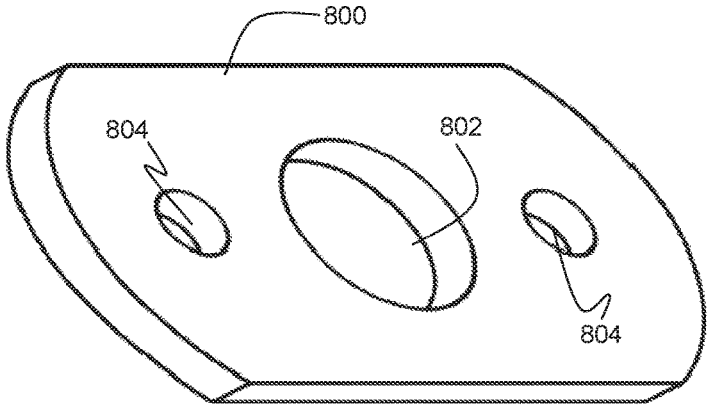
FIG. 10B is a perspective view depicting a piston washer for a rotatable shock absorber assembly, according to an embodiment.

FIGS. 10A and 10B are plan and perspective views of optional piston washer 800 that can be provided in embodiments. Piston washer 800 can have an elongate shape similar to flange 504 of piston 500. Piston washer can be relatively flat along the elongate axis with a height of between about 0.5 mm to about 2 mm. Piston washer 800 can define a centrally arranged joint aperture 802, which can be sized, shaped, and position to allow joint stem 508 to pass therethrough. Piston washer 800 can further define pin apertures 804, which can each be sized, shaped, and positioned to allow rotation pins 410 to pass therethrough. Piston washer 800 can comprise copper, aluminum, steel, other ferrous or non-ferrous metals, or elastomeric substances.

Piston washer 800 can facilitate more even rotation of joint 402 (and therefore saddle 16) about elongate axis 36 relative to piston 500 and support leg 12. The sliding action of the relatively smooth plastic outer surfaces of joint 402 and piston 500 can cause undesirable sticking in some instances. Piston washer 800 can mitigate this sticking by acting as a buffer between the two surfaces. In addition, wear of the plastic surfaces between joint 402 and piston 500 can lessen rotational tension over time, resulting in an undesirably loose rotation of saddle 16. Piston washer 800 mitigate the effects of this wear, and maintain the rotational tension of joint 402 (and therefore also saddle 16) relative to piston 500.

FIG. 11A is an exploded perspective view depicting a rotatable shock absorber assembly 400 according to an embodiment. FIG. 11B is a perspective view depicting an assembled embodiment. Guide pin 518 can be a two-piece barrel (or post-and-screw) bolt, in which a screw can be threaded into a barrel shaped flange. In other embodiments, other fasteners or combinations of fasteners of sufficient length to pass through upper portion 20 of support leg 12 used. For example, guide pin 518 can comprise a carriage bolt and a nut. Guide pin 518 can be insertable through a pair of apertures 704 defined within upper portion 20 of support leg 12. In embodiments, more than one pair of apertures 704 can be provided, enabling adjustment of the location of guide pin 518 (and therefore, the travel of piston 500).

As assembled, piston washer 800 can be arranged between flange 504 of piston 500 and bottom face 406 of joint 402, such that joint stem 508 protrudes through joint aperture 802 and is arranged within joint bore 412 and rotation pins 410 protrude through pin apertures 804 and are arranged within rotation grooves 512. Tilt springs 404 are inserted into tilt spring holders 414. Screw 518 and washer 522 can fasten joint 402 to piston 500. Block 600 is arranged within upper portion 20 of support leg 12. Piston spring 520 is compressed between block 600 and piston 500 such that coils of piston spring 520 are at least partially wrapped around block stem 514 and spring pin 604. Guide pin 518 is inserted through apertures 704 of the upper portion and piston slot 516.

In operation, embodiments of rotatable shock absorber assembly 400 described above can function to provide walking assistance to a patient. In embodiments, joint 402 provides one degree of rotational freedom oriented so that support leg 12 pivots back and forth with respect to the saddle along a path parallel to that of the user. In embodiments, joint 402 rotates relative to piston 500 in a plane normal to crutch axis 30, enabling support leg 12 to move along an outwardly arced path.

In embodiments, movement of saddle 16 upwards or downwards along crutch axis is facilitated by piston 500, guide pin 518, and piston spring 520. In operation, pressure can be asserted on joint 402 which will urge piston 500 deeper into upper portion 20, compressing piston spring 520, until guide pin 518 engages with the top edge of piston slot 516. When the pressure is released, piston spring 520 can urge piston 500 upwards, until guide pin 518 engages with the bottom edge of piston slot 516.

Embodiments of the present disclosure provide numerous improvements over conventional devices, including those mentioned here. For example, guide pin 518 is a separate component from piston 500. Guide pin 518 can therefore be manufactured independently of piston 500 and consist of a material with higher strength, such as steel bolts. In addition, because guide pin is fixed at a vertical position in support leg 12, support leg 12 does not need to present elongated external slots, which can be more susceptible to wear. The fixed guide pin 518 also avoids the risk of catching and/or abrading the users skin and/or clothing. Saddle 16, therefore, does not have to incorporate additional flaps or tabs to cover guide pin 518.

Wear can also be reduced by spreading the force of contact across the width of piston 500. In conventional exposed pin designs the full force of the pins contacting the slots is borne by the slots defined in the hollow support leg. Because the leg is optimally lightweight, it is often constructed of a material, such as aluminum, having thin walls. Excessive wear can therefore occur at the tops and bottoms of the slots. In contrast, piston slot 516 spans the width of piston 500 in disclosed embodiments. The contact pressure between the slot 516 and pin 518 is therefore spread across the width. This internal piston design can protect the piston and the bolt, and inhibit wear in comparison with other designs in which slots are presented as apertures in the crutch leg.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. A rotatable shock absorber assembly for a crutch having a support leg having a hollow upper portion extending along a generally vertical elongate axis, and a saddle adapted for arrangement within an armpit of a user, the rotatable shock absorber assembly comprising:

a guide pin, removably fixable within the upper portion of the support leg, and extending along an axis orthogonal to the elongate axis;

a piston including— a flange arranged proximate the saddle, including a top surface having two or more arcuate rotation grooves defined therein, a main body, slideably arrangable within the upper portion of the support leg and defining an elongate slot enabling the guide pin to be inserted therethrough, such that the piston can translate along the elongate axis relative to the guide pin;

a joint, operably coupling the piston to the saddle, the joint including two or more rotation pins, each slidably insertable within a respective one of the two or more arcuate rotation grooves such that the joint can rotate about the elongate axis relative to the piston; and a biasing mechanism configured to urge the piston along the elongate axis toward the armpit of the user;

whereby the saddle can be held stable in the armpit of the user and the support leg can rotate about, and translate along the elongate axis during use of the crutch by the user.

2. The rotatable shock absorber assembly of claim 1, whereby the biasing mechanism comprises:

a block fixedly arranged within the upper portion of the support leg at a position distal to the saddle relative to the piston; and a compression spring arranged between the block and the piston.

3. The rotatable shock absorber assembly of claim 2, wherein the block comprises an upwardly extending spring pin receivable within one or more lower coils of the spring, and wherein the piston comprises a downwardly extending block stem receivable within one or more upper coils of the spring.

4. The rotatable shock absorber assembly of claim 1, wherein the flange has a size and shape inhibiting the entry of the flange into the upper portion of the support leg.

5. The rotatable shock absorber assembly of claim 1, wherein the extent of the translation of the piston relative to the guide pin is limited by the length of the slot along the elongate axis.

6. The rotatable shock absorber assembly of claim 1, further comprising a piston washer arrangable at a bottom face of the joint.

7. The rotatable shock absorber assembly of claim 6, wherein the piston washer is composed of copper.

8. The rotatable shock absorber assembly of claim 1, wherein the joint is tiltably coupled to the saddle such that the saddle can remain fixed within the armpit of the user while the support leg is pivoted between the front side of the user and the back side of the user.

9. A crutch having a first side direction generally parallel to a walking direction of a user, a second side direction opposite the first side direction, a third side direction perpendicular to the first side direction and a fourth side direction opposite the third side direction, comprising:

a saddle, extending in an elongate shape between the first side direction and the second side direction, the saddle including— an inner lobe configured to rest against a torso of the user during use, an outer lobe configured to rest against an arm of the user during use, and a top portion connecting the inner lobe and the outer lobe and forming a U-shaped channel having an curved upper surface configured to fit within an armpit of the user with the U-shaped channel open along at least a portion of a downward facing side;

a support leg pivotably connected to the saddle at by a rotatable shock absorber assembly having a joint disposed within the U-shaped channel, the support leg having an upper portion proximate the joint and extending downward from the saddle along an elongate axis;

wherein the rotatable shock absorber assembly includes:

a guide pin, removably fixable within the upper portion of the support leg, and extending along an axis orthogonal to the elongate axis;

a piston including— a flange arranged proximate the saddle comprising a top surface having two or more arcuate rotation grooves defined therein, and a main body, slideably arrangable within the upper portion of the support leg and defining an elongate slot enabling the guide pin to be inserted therethrough, such that the piston can translate along the elongate axis relative to the guide pin;

the joint, operably coupling the piston to the saddle, the joint comprising two or more rotation pins, each slidably insertable within a respective one of the two or more arcuate rotation grooves such that the joint can rotate about the elongate axis relative to the piston; and a biasing mechanism configured to urge the piston along the elongate axis toward the armpit of the user;

whereby the saddle can be held stable in the armpit of the user and the support leg can rotate about, and translate along the elongate axis during use of the crutch by the user.

10. A crutch having a first side direction generally parallel to a walking direction of a user, a second side direction opposite the first side direction, a third side direction perpendicular to the first side direction and a fourth side direction opposite the third side direction, the crutch comprising:

a support leg having a top end and a bottom end, including— a bottom portion proximate the bottom end, a middle portion disposed to the first side direction of an axis extending between the top end and the bottom end, and disposed to the third side direction of the axis extending between the top end and the bottom end, and a top portion proximate the top end extending along an elongate axis;

a cantilevered handle extending in an elongate shape from a fixed end arranged at the middle portion of the support leg to a free end; and a saddle coupled to the top end of the support leg by a rotatable shock absorber assembly;

wherein the rotatable shock absorber assembly includes— a guide pin, removably fixable within the upper portion of the support leg, and extending along an axis orthogonal to the elongate axis, a piston including:

a flange arranged proximate the saddle comprising a top surface having two or more arcuate rotation grooves defined therein, and a main body, slideably arrangable within the upper portion of the support leg and defining an elongate slot enabling the guide pin to be inserted therethrough, such that the piston can translate along the elongate axis relative to the guide pin, a joint, operably coupling the piston to the saddle, the joint comprising two or more rotation pins, each slidably insertable within a respective one of the two or more arcuate rotation grooves such that the joint can rotate about the elongate axis relative to the piston, and a biasing mechanism configured to urge the piston along the elongate axis toward the armpit of the user;

whereby the saddle can be held stable in an armpit of the user and the support leg can rotate about, and translate along the elongate axis during use of the crutch by the user.

* * * * *